United States Patent [19]

Goerens

[11] Patent Number: 4,671,980

[45] Date of Patent: Jun. 9, 1987

[54] METHOD AND APPARATUS FOR GENERATING AN ELECTROSTATIC FIELD FOR FLOCKING A THREAD-LIKE OR YARN-LIKE MATERIAL, AND THE FLOCKED ARTICLE THUS PRODUCED

[75] Inventor: Robert L. Goerens, L-Esch/Alzette, Luxembourg

[73] Assignee: Uniroyal Englebert Textilcord S.A., Steinfort, Luxembourg

[21] Appl. No.: 863,200

[22] Filed: May 14, 1986

Related U.S. Application Data

[62] Division of Ser. No. 706,638, Feb. 28, 1985, Pat. No. 4,622,235.

[30] Foreign Application Priority Data

Jun. 26, 1984 [DE] Fed. Rep. of Germany ..... 3423462

[51] Int. Cl.[4] ..... B05D 1/16

[52] U.S. Cl. ..... 428/90

[58] Field of Search ..... 428/90; 427/25, 26

[56] References Cited

U.S. PATENT DOCUMENTS 3,583,890 6/1971 Kolckmann ..... 428/90

3,968,283 7/1976 Schutte ..... 428/90

*Primary Examiner*—Marion C. McCamish

*Attorney, Agent, or Firm*—Becker & Becker, Inc.

[57] ABSTRACT

A method and apparatus for electrostatically flocking a thread-like or yarn-like material. This material rectilinearly and continuously or intermittently is moved through an electrical field which is generated between electrodes having non-planar yet symmetrical potential surfaces. This electrical field preferably is generated between curved potential surfaces of the electrodes. The flock is shot into the adhesive coating of a given thread not only radially but also at an angle. The thread does not have to be turned. As a result, a dense and improved flocking is achieved all around the yarn or thread in a simple and economical manner.

3 Claims, 8 Drawing Figures

METHOD AND APPARATUS FOR GENERATING AN ELECTROSTATIC FIELD FOR FLOCKING A THREAD-LIKE OR YARN-LIKE MATERIAL, AND THE FLOCKED ARTICLE THUS PRODUCED

This is a divisional application of parent SN 706,638—Goerens filed Feb. 28, 1985 now U.S. Pat. No. 4,622,235.

BACKGROUND OF THE INVENTION

1. Field of the Invention

The present invention relates to a method of generating an electrostatic field of high potential or voltage for electrostatically flocking a threadlike or yarn-like material, i.e. covering said material with fibers, with said material, in the form of a number of grounded threads or yarns which are provided with an adhesive, being moved through an electrostatic field of high voltage which is effective between the potential surfaces of electrodes. Under the effect of this field, the flock material, which is supplied on an electrically non-conductive conveyer which is disposed above the lower electrode and above the threads of the group of threads, is accelerated in the direction toward the threads of the group of threads, and is shot into the adhesive coating of the threads.

The present invention also relates to an apparatus for carrying out the aforementioned method, and comprises a flocking chamber formed from a lower and an upper electrode, with each of said electrodes having an electrostatically operating potential surface, and being connectable to a high electrical voltage. A continuous conveying means for supplying flock material is disposed between the electrodes. Disposed ahead of the flocking chamber is an adhesive-applying mechanism for the group of threads, which can be withdrawn from a spool frame. Disposed after the flocking chamber is a drying chamber for the flocked threads. The threads are held rectilinearly by a stretching device, and are wound up by a winding apparatus.

The present invention furthermore relates to the flocked article which is produced pursuant to the aforementioned method and apparatus. The flocked article thus produced comprises threads or yarns which are surrounded by an adhesive coating in which is anchored flock that is essentially shot in electrostatically radially all around the threads or yarns.

2. Description of the Prior Art

With the conventional means for electrostatically flocking threads or yarns moved as a group of threads through an electrical field, threads or yarns which are flocked all the way around cannot be obtained. Such flocked articles are of a band-like nature, because essentially only those surfaces of the threads which face the planar potential surfaces of the electrodes are flocked.

On the other hand, however, pursuant to German Pat. No. 16 35 235, yarns and threads which are flocked all the way around can be obtained if the threads are rotated about their longitudinal axes as they move through the electrical field. However, the drawback to this known procedure is that the threads must be continuously rotated. Moreover, the flock density of the thread which is obtained could be much improved.

An object of the present invention is to provide, among other things, a method of electrostatically flocking threads or yarns, according to which any yarn or thread can be densely and optimally flocked all the way around without having to rotate the yarn or thread. Furthermore, the shortcomings of the heretofore known methods are to be avoided.

BRIEF DESCRIPTION OF THE DRAWING

These objects, and other objects and advantages of the present invention, will appear more clearly from the following specification in conjunction with the accompanying drawing, in which.

SUMMARY OF THE INVENTION

Figure 1:
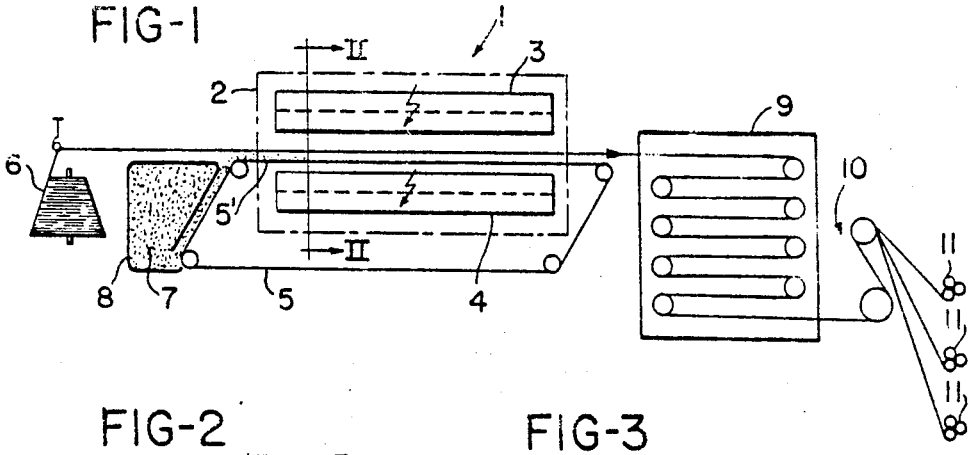
FIG. 1 schematically illustrates one inventive embodiment of a thread-flocking apparatus.

The method of the present invention is characterized primarily in that an electrical field is generated between non-planar potential surfaces of the electrodes in the positive direction transverse to the longitudinal direction of the threads, in that these potential surfaces are operational symmetrical to each thread of the group of threads, and in that the threads are moved through the electrical field rectilinearly in the longitudinal direction of the threads.

As a result of such an electrostatic field, which is generated between the non-planar potential surfaces of the electrodes, the threads of the group of threads are densely flocked with flock material all the way around without having to thereby rotate the threads or the electrodes.

In a very simple manner, the electrical field is generated between potential surfaces which are concavely curved relative to the threads.

In an electrostatic field, the flock is always shot off and accelerated at right angles relative to the potential surfaces of the electrodes. When the potential surfaces are non-planar, the flock follows shorter and longer lines of flux. Flock which thereby reaches the region of the grounded threads of the group of threads, or which contacts the adhesive coating of the threads, is drawn to the threads and overcomes the influence of the flux lines The deviation of the direction of flight of the flock is slight, and can be up to 30°. The velocity and the mass of the flock permit this for a brief period of time As a result, a large portion of the flock is shot at an angle into the adhesive coating in an electrical field between non-planar potential surfaces of the electrodes. These portions of the flock are sufficient to densely and uniformly flock the threads without any kind of rotation being required. The flock is anchored in the adhesive coating both radially as well as at an angle to the threads. A high flock density is thereby produced.

The electrical field can be generated between sinusoidal potential surfaces of the electrodes, with each thread being moved through between the sinus troughs of the electrodes. The electrical field can also be generated between other curved potential surfaces, such as circular-arc-curved potential surfaces, in the direction transverse to the longitudinal direction of the threads, with each of the threads being moved through at a position corresponding essentially to the center of the radius of curvature.

The potential surfaces of the electrodes can also be wavelike or stepped. Furthermore, the upper and lower electrodes can be divided into a plurality of individual electrodes.

In order to increase the flocking density, it is also possible to produce an electrical field having different intensities. This effect is utilized to flock the threads as they pass through the electrical field to such a density that by the time the end of the field is reached, there is no more place on the adhesive coating of the thread for the flock which is being shot back and forth. It should be noted that the threads can be moved either continuously or intermittently. Flocking of the thread all around it can also be effected during thread standstill. In this case also a field having any desired and varied intensity can be generated.

The apparatus of the present invention for carrying out the aforementioned method is characterized primarily in that the potential surfaces of the electrodes are non-planar, especially curved, in the direction transverse to the longitudinal direction of the threads, and are symmetrically disposed relative to the threads.

Pursuant to preferred uniform curvatures for the potential surfaces of the electrodes, these surfaces can be concavely curved, with the threads being centrally disposed therebetween. The potential surfaces can also be wavelike, being arranged symmetrically to the plan of the threads. The potential surfaces can also be incremental or stepped, and can furthermore be disposed at an incline relative to the longitudinal direction of the threads. It is furthermore possible to have potential surfaces which, relative to the longitudinal transverse directions of the threads, are three-dimensionally extended, with troughs and loops being provided. Such three-dimensional configurations can include spherical, frusto-pyramidal, and frusto-conical shapes.

An electrical field having flux lines of various lengths can be produced between such electrodes; this is particularly advantageously suited for flocking all around threads or yarns. Again, the electrodes can be incremental or stepped, and can also be partial electrodes. Varying high voltages can be applied.

It should also be noted that the distances of the electrodes to the threads can be varied. Furthermore, the electrodes can be inclined relative to one another in the direction of travel of the threads. As a result of these measures, a fundamental control and intensification of the flocking can be effected.

In the flocked thread or yarn, flock has entered the adhesive coating not only in the radial direction but also in a direction which is at an angle to the radial direction, with both the radially and nonradially directed flock being present in a uniform, dense distribution and in an irregular pattern.

DESCRIPTION OF PREFERRED EMBODIMENTS

Referring now to the drawing in detail, the flocking apparatus 1 of FIG. 1 essentially comprises a flocking chamber 2. The chamber 2 includes an upper electrode 3 and a lower electrode 4, between which is disposed the portion 5' of an endless conveyer 5. The reference numeral 7 designates the flock, and the reference numeral 8 designates a flock container, which has dosing means. A number of threads 12 (see also the reference numeral 12' in FIG. 3) are withdrawn from a spool frame 6. These threads are flocked, or covered with fibers, in the flocking chamber 2, and are rectilinearly held or moved through a stretching device 10. In this case, stretching denotes holding the threads in such a way that they do not droop. Depending upon the shrinkage of the threads, the appropriate change in length is taken into account.

The flocked threads are dried in a drying device 9, and are wound up with the aid of a winding apparatus 11

Figure 2:
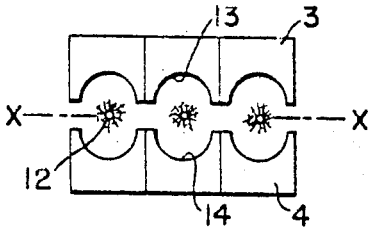
FIG. 2 is a cross section through electrodes having a curved surface, and is taken along the line II—II in FIG. 1.

FIG. 2 shows the fundamental construction of the non-planar potential surfaces 13 and 14 of the upper and lower electrodes 3 and 4, which in this case are in the form of a curvature. These surfaces 13, 14 are concavely curved, and are disposed symmetrically relative to the threads 12 The distances of the potential surfaces 13, 14 from the threads can be varied; however, this distance is always the same relative to these threads. An electrical field of high potential or voltage is generated between the potential surfaces 13, 14; the lines of flux of this electrical field vary in length. Flocked threads 12 are schematically shown in FIG. 2.

The upper electrode 3 is connected, for example, to a high voltage of +55 KV, and the lower electrode is connected, for example to a high voltage of −45 KV. Due to the effect of the electrical field, the flock which is conveyed by the conveyer 5, 5' into the flocking chamber 2 is shot back and forth between the potential surfaces 13, 14. Each grounded thread 12 is surrounded by a non-illustrated adhesive coating, and is provided in this region with an electrically neutral field. Part of the flock which is being shot back and forth enters the adhesive coating essentially radially. In the region of the neutral zone, other parts of the flock are withdrawn from the influence of the flux lines and are also shot into the adhesive coating, but at a slight inclined angle which can be up to 30°. In this way, the two sides of the threads which do not face the potential surfaces are also filled or packed with flock which is shot in partially radially and partially at an angle until the thread is thickly covered all around with flock.

Figure 3:
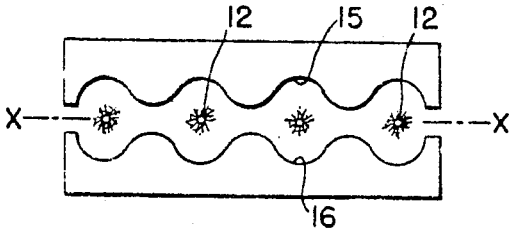
FIG. 3 is a cross section through a modified arrangement of electrodes having a wavelike surface.
Figure 4:
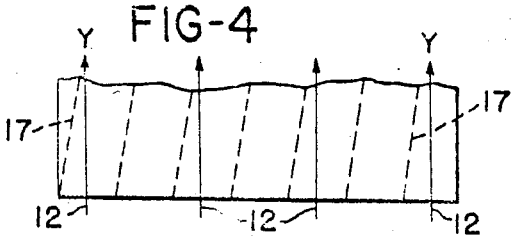
FIG. 4 is a schematic plan view of a further modification of electrodes.

FIG. 3 illustrates one preferred specific embodiment of the potential surfaces. The electrode surfaces 15, 16 have a uniform wavelike construction; in particular, they are symmetrical to the plane or direction x, which extends at right angles to the longitudinal axis of the threads. The reference numeral 12' indicates the group of threads 12. The threads in each case are preferably disposed centrally between the symmetrical valleys or troughs of the waves. Lengthwise, the troughs and loops of the electrode surfaces extend essentially parallel to the longitudinal axes of the respective threads. However, these troughs and loops can also have an orientation of the channels 17 of the potential surfaces which extends at an angle up to diagonally relative to the longitudinal axis of the threads. Such a configuration is illustrated in FIG. 4.

Figure 5:
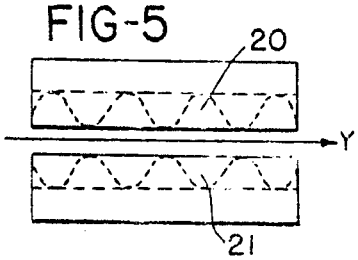
FIG. 5 shows an arrangement of electrodes having three-dimensional channels of their surface in and transverse to the direction of travel of the threads.

FIG. 5 shows an arrangement of electrodes 20, 21 having potential surfaces which are three-dimensionally constructed not only transverse to, but also in, the longitudinal direction y of the threads. Such a construction, can include, for example, spherical or frusto-pyramidal channels. Any type of "volumetric" channel having symmetrical troughs and loops is possible.

Figure 6:
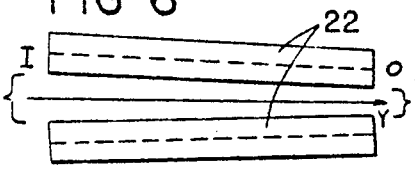
FIG. 6 shows an arrangement of electrodes which are inclined in the direction of travel of the threads.

FIG. 6 shows an arrangement of electrodes 22 which are inclined relative to one another when viewed in the longitudinal direction y of the threads. Preferably, the distance I at the inlet side is greater than the distance O at the outlet side. In the region of the smaller electrode gap, the flocking is more intensive than it is where the electrodes are spaced further apart.

Figure 7:
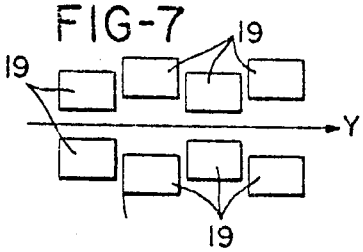
FIG. 7 shows an arrangement of a plurality of electrodes which are stepped in the direction of travel of the threads.

FIG. 7 shows an arrangement of incremental or stepped electrodes 19, which are provided as partial electrodes. Each pair of electrodes can assume a specific and arbitrarily selectable distance relative to the group of threads. Furthermore, each electrode can be connectable to a specific and selectable high voltage In this manner, an individually graduated flocking is possible.

Figure 8:
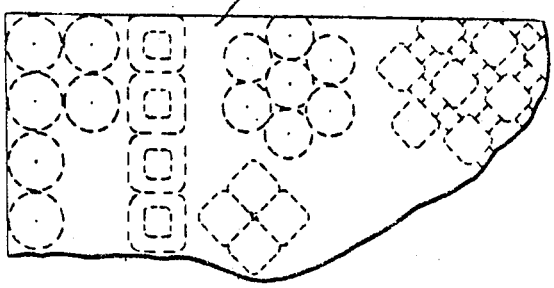
FIG. 8 is a plan view of portions of different potential surfaces of an electrode which has a three-dimensional configuration.

FIG. 8 is a plan view of one of many possible three-dimensional surface configurations for the electrodes 20, 21, which are adapted to generate between non-planar potential surfaces an electrical field having varying lengths of the flux lines, in order to flock threads which are not rotated as they pass through the field.

The present invention is, of course, in no way restricted to the specific disclosure of the specification and drawing, but also encompasses any modifications within the scope of the appended claims.

What I claim is:

1. A flocked article of filaments, each of which is surrounded by an adhesive coating in which is anchored, all the way around, electrostatically shot-in flock; the improvement wherein said flock is present in said adhesive coating not only in a radial direction, but also at an angle to the radial direction, with the radial and non-radial flock being present in a uniform, dense distribution, yet in an irregular pattern.

2. A flocked article of filaments according to claim 1, wherein said angle to the radial direction is inclined up to 30°.

3. A flocked article of filaments according to claim 2, where two sides of filaments other than those facing potential surfaces are also filled with flock which is shot in partially radially and partially at an angle until the filament is thickly covered all around with the flock.

* * * * *